US008425258B2

(12) United States Patent
Mislan et al.

(10) Patent No.: US 8,425,258 B2
(45) Date of Patent: Apr. 23, 2013

(54) APPARATUS AND SYSTEM FOR ELECTRONIC DEVICE INTERROGATION AND DATA EXTRACTION

(75) Inventors: Richard P. Mislan, Battle Ground, IN (US); Sean Lane, Columbia, MD (US)

(73) Assignees: Purdue, Research Foundation, West Lafayette, IN (US); Battlefield Telecommunications Systems, LLC, Columbia, MD (US)

( * ) Notice: Subject to any disclaimer, the term of this patent is extended or adjusted under 35 U.S.C. 154(b) by 0 days.

(21) Appl. No.: 13/366,442

(22) Filed: Feb. 6, 2012

(65) Prior Publication Data

US 2012/0164885 A1 Jun. 28, 2012

Related U.S. Application Data

(63) Continuation of application No. 13/028,147, filed on Feb. 15, 2011, now Pat. No. 8,123, 564.

(60) Provisional application No. 61/304,559, filed on Feb. 15, 2010.

(51) Int. Cl.
*H01R 13/625* (2006.01)

(52) U.S. Cl.
USPC ..... 439/669

(58) Field of Classification Search ..... 439/625, 439/669, 101, 937, 607.43
See application file for complete search history.

(56) References Cited

U.S. PATENT DOCUMENTS

| | | | | |
|---|---|---|---|---|
| 2010/0046553 | A1* | 2/2010 | Daigle et al. | 370/474 |
| 2011/0028790 | A1* | 2/2011 | Farr et al. | 600/187 |
| 2011/0102775 | A1* | 5/2011 | Palmer et al. | 356/124 |

* cited by examiner

*Primary Examiner* — Jean F Duverne
(74) *Attorney, Agent, or Firm* — Anthony P. Filomena; Taft, Stettinius & Hollister, LLP.

(57) ABSTRACT

An apparatus for connecting a computing device to different types of mobile devices that includes an enclosure that encloses a USB hub, mobile device cables connectable to different mobile devices, and a USB cable connectable to a computing device to extract data from connected mobile devices. The mobile device cables are coupled to the USB cable through the USB hub. The apparatus can include multimedia card readers within the enclosure that are coupled to the USB hub and connectable to different types of multimedia cards to extract data from connected multimedia cards. The multimedia card readers can be write-protected to only read information from connected multimedia cards. The apparatus can include biometric data gathering tools, camera or light within the enclosure. The enclosure can be tube, notebook or flask shaped. The apparatus can also include a wiring harness that seals one end of the enclosure from the other end.

19 Claims, 14 Drawing Sheets

APPARATUS AND SYSTEM FOR ELECTRONIC DEVICE INTERROGATION AND DATA EXTRACTION

CROSS-REFERENCE TO RELATED APPLICATIONS

This application is a continuation of U.S. patent application Ser. No. 13/028,147, filed on Feb. 15, 2011, entitled "Apparatus and System for Electronic Device Interrogation and Data Extraction," which claims priority to U.S. Provisional Application Ser. No. 61/304,559, filed on Feb. 15, 2010, entitled "Enclosure for Mobile Device Forensics and Exploitation, and Applications Thereof," which are all incorporated herein by reference.

BACKGROUND

The present invention relates generally to systems for interrogation of electronic devices, and more particularly to a system for interrogating electronic devices and an enclosure with multiple cables and connectors for connecting to any of various electronic devices to a computer.

Law enforcement personnel, first responders, military personnel, intelligence agents, and others sometimes need to extract data from mobile devices for investigative purposes. Systems have been developed that download data from mobile devices, such as mobile phones. However, different mobile devices have different connectors and storage devices, and have different protocols for accessing their content.

To determine a connector and protocol for communicating with the mobile device, systems often require a user to specifically identify the model of the mobile device. This can be tedious and time-consuming for the user. Further, generally systems download all the information from the mobile device before displaying the data to the user and enabling the user to search and interpret the data. In investigative applications, waiting for all the data to download may require that the mobile device be brought to a forensic lab.

Systems and methods are needed to quickly and easily connect to and interrogate the content of mobile devices.

SUMMARY

An apparatus is disclosed for connecting a computing device to different types of mobile devices. The apparatus includes an enclosure that encloses a USB hub, a plurality of mobile device cables and a USB cable. The mobile device cables are coupled to the USB cable through the USB hub. The mobile device cables are configured to connect to different types of mobile devices. The USB cable is configured to connect to a computing device to extract data from a mobile device coupled to one of the mobile device cables. The mobile device cables can be configured to connect to at least one of a cell phone, a smart phone, a personal data assistant, a portable audio player and a portable hard drive.

The apparatus can also include a plurality of multimedia card readers enclosed within the enclosure, the multimedia card readers being coupled to the USB hub and configured to connect to different types of multimedia cards such that a computing device coupled to the USB cable can extract data from a multimedia card coupled to one of the multimedia card readers. The multimedia card readers can be configured to connect to at least one of a compact flash card, a secure digital (SD) card, a mini-SD card, a micro-SD card, an extreme digital (XD) card, a SONY memory stick, a memory stick pro, a memory stick micro (M2) smart card, a subscriber identity module (SIM) card, and a USB thumb drive. At least one of the multimedia card readers can be write-protected to only read information from a connected multimedia card.

The apparatus can also include a biometric data gathering tool enclosed within the enclosure. The biometric data gathering tool can be a fingerprint scanner or an iris scanner.

The apparatus can also include a cover coupled to the enclosure, where the cover moves between an open position that exposes the plurality of multimedia card readers and a closed position that encloses the plurality of multimedia card readers in the enclosure behind the cover. The apparatus can also include rails on the enclosure so that the cover slides along the rails between the open position and the closed position. Alternatively, the apparatus can include hinges coupling the cover to the enclosure so that the cover hingedly moves between the open position and the closed position.

The enclosure can have a tubular exterior shape extending from a first end enclosing the USB cable to a second end enclosing the plurality of mobile device cables. The apparatus can also include a first end cap covering the first end of the enclosure and a second end cap covering the second end of the enclosure. The first and second end caps can screw onto the first and second ends of the enclosure. The apparatus can also include first and second cords, where the first cord couples the first end cap to the enclosure and the second cord couples the second end cap to the enclosure.

The apparatus can also include a camera on a flexible arm, where the flexible arm moves from an enclosed position where the camera is within the enclosure to an extended position where the camera is extended outside of the enclosure. The apparatus can also include a light that moves from an enclosed position within the enclosure to an extended position outside of the enclosure.

The apparatus can also include a wiring harness within the enclosure, where the wiring harness separates the enclosure to form a proximal side and a distal side, and seals the proximal side from the distal side. The plurality of mobile device cables can be on the distal side of the wiring harness; and the USB hub, the USB cable and the plurality of multimedia card readers can be on the proximal side of the wiring harness.

The exterior of the enclosure can be shaped like a leather notebook, or like a flask. The battery of a mobile device coupled to one of the mobile device cables can be charged.

BRIEF DESCRIPTION OF THE DRAWINGS

In the drawings, like reference numbers may indicate identical or functionally similar elements.

DETAILED DESCRIPTION OF EXEMPLARY EMBODIMENTS

Figure 1:
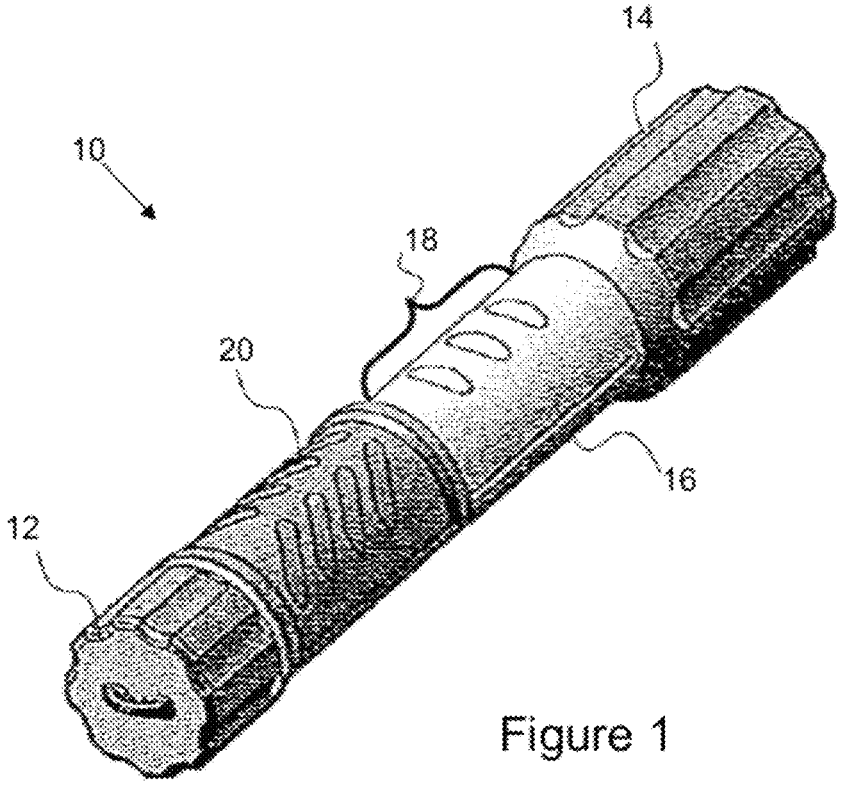
FIG. 1 illustrates a top view of an exemplary embodiment of an apparatus for enclosing mobile device data cables and multimedia card readers.

For the purposes of promoting an understanding of the principles of the technology, reference will now be made to the embodiments described herein and illustrated in the drawings and specific language will be used to describe the same. It will nevertheless be understood that no limitation of the scope of the technology is thereby intended, such alterations and further modifications in the illustrated devices and methods, and such further applications of the principles of the technology as illustrated therein being contemplated as would normally occur to one skilled in the art to which the technology relates.

An apparatus is disclosed that encapsulates multiple mobile device data cables and multimedia card readers within an enclosure which can have a tubular exterior shape. The enclosure stores and protects the cables and multimedia card readers when they are not in use. The cables may be stationary and capped off for protection, or the cables may be on a sliding mechanism that allows them to be extended for use. The apparatus can include a sliding cover coupled to the enclosure that exposes the multimedia card readers that are housed in the apparatus. The apparatus can also include a connecting universal serial bus (USB) cable that can attach the enclosed wiring to any computer with a receiving USB port. The apparatus may be useful, for example, in law enforcement and military applications to quickly and easily connect to mobile devices (for example, cell phones, PDAs, smart phones, and multimedia cards) and download their content to a computer.

FIG. 1 illustrates a top view of an exemplary apparatus 10 for enclosing mobile device data cables and multimedia card readers. The apparatus 10 includes a tubular shaft 16 with a grip 18. The shaft 16 may be substantially cylindrical or have another exterior shape. For example, the shaft 16 may have a cylindrical midsection with sockets protruding at its terminal ends. The tubular shaft 16 may be at least partially made out of a composite material in compliance with MIL-SPEC guidelines.

The apparatus 10 also includes a slide cover 20 that encloses one or more multimedia card readers. The tubular shaft 16 may include Teflon-coated rails that enable the cover 20 to slide along the shaft 16 to expose the enclosed multimedia card readers. In another embodiment, the cover 20 may be hinged on the shaft 16. The enclosed multimedia card readers may read, for example, a compact flash card, a secure digital (SD) card, a mini-SD card, a micro-SD card, an extreme digital (XD) card, a SONY memory stick, a memory stick pro, a memory stick micro (M2) smart card, or a subscriber identity module (SIM) card.

In this exemplary embodiment, the apparatus 10 also includes a first end cap 12 and a second end cap 14. The end caps 12 and 14 cover the terminal ends of the tubular shaft 16. The first cap 12 covers a male USB cable configured to connect to a computing device. The second cap 14 covers one or more cables configured to connect to one or more mobile devices. The second cap 14 may cover any number of different cables. For example, the second cap 14 may cover ten to twelve different cables, each configured to connect to a different type of mobile device. Different mobile device manufacturers may support different types of cables. For example, cap 14 may cover mini USB cables, SONY ERICSSON cables, NOKIA cables, and AUDIOVOX cables.

The caps 12 and 14 may detach from the shaft 16 by unscrewing, by sliding off, or by other attachment mechanisms. The caps 12 and 14 detach to enable a user to connect the enclosed cables to a computer and to different types of mobile devices to read data from the mobile devices. The caps 12 and 14 also protect the cables when not in use.

In an alternative embodiment not shown, each of the terminal ends of the tubular shaft 16 can include a button. When the button is depressed at one end, the cable(s) at that end may be extended from within the tubular shaft 16 to enable a user to connect to a desired mobile device or computer. In this embodiment, the detachable caps may not be needed.

In other embodiments, other devices may be enclosed in the apparatus 10 and extend from the terminal ends of the shaft 16. For example, a camera on a flexible arm may be enclosed in the shaft 16. The flexible arm can move from an enclosed position where the camera is within the shaft 16 to an extended position where the camera is extended outside of the shaft 16. A light, for example an LED light, may be extendable from an end of the shaft 16; or an iris scanner may be extendable from an end of the shaft 16.

Figure 2:
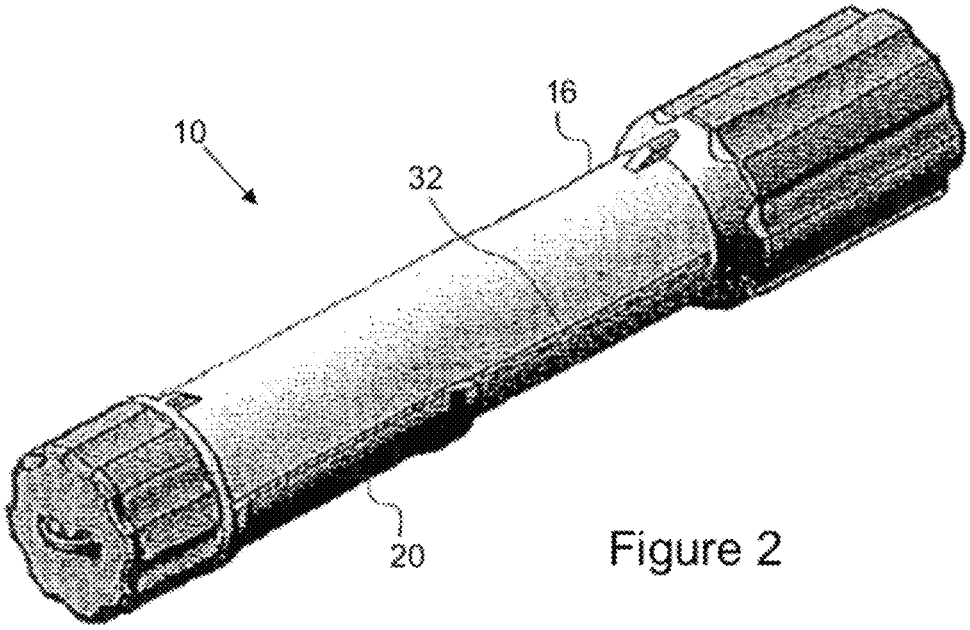
FIG. 2 illustrates a bottom view of the exemplary embodiment in FIG. 1.
Figure 4:
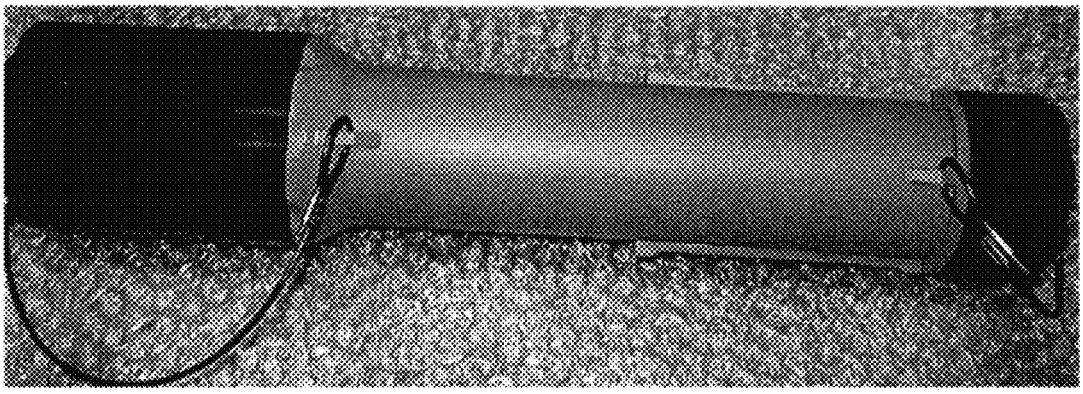
FIG. 4 is a photograph of a bottom view of the exemplary embodiment in FIG. 3.

FIG. 2 is a photograph of a top view and FIG. 4 is a photograph of a bottom view of an exemplary embodiment of the apparatus 10. In addition to the components shown in FIG. 1, FIG. 2 shows an embodiment of the apparatus 10 that includes cords 22 and 24. The cords 22 and 24 attach the shaft 16 to the caps 12 and 14, respectively. The cords 22 and 24 can be at least partially made out of aircraft cable or other material. By attaching the caps 12 and 14 to the shaft 16, the cords 22 and 24 help prevent the caps 12 and 14 from being separated from the apparatus 10 and getting lost.

Figure 3:
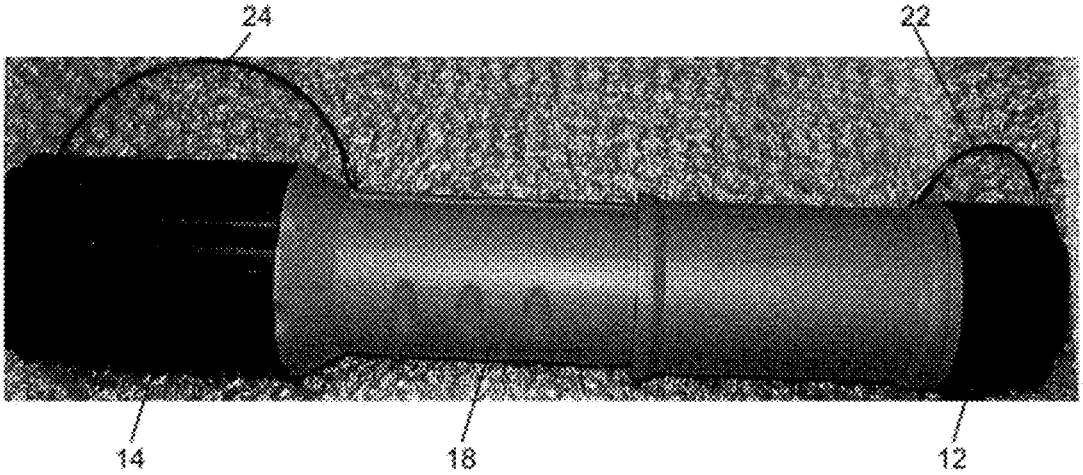
FIG. 3 is a photograph of a top view of an exemplary embodiment of an apparatus for enclosing mobile device data cables and multimedia card readers.

FIG. 3 illustrates a bottom view of the apparatus 10. FIG. 3 shows that the apparatus 10 can include a rail 32 enabling the cover 20 to slide lengthwise along the shaft 16. As mentioned above, there may be another rail (not shown) on the opposite side of the shaft 16, and the cover 20 may slide along both rails. Each rail may include Teflon tape or coating that reduces friction caused by the cover 20 moving along the shaft 16. In this way, the cover 20 may slide more easily and with less wear. For example, the cover 20 may slide between an open position exposing one or more multimedia card connections and a closed position covering the connections.

Figure 5:
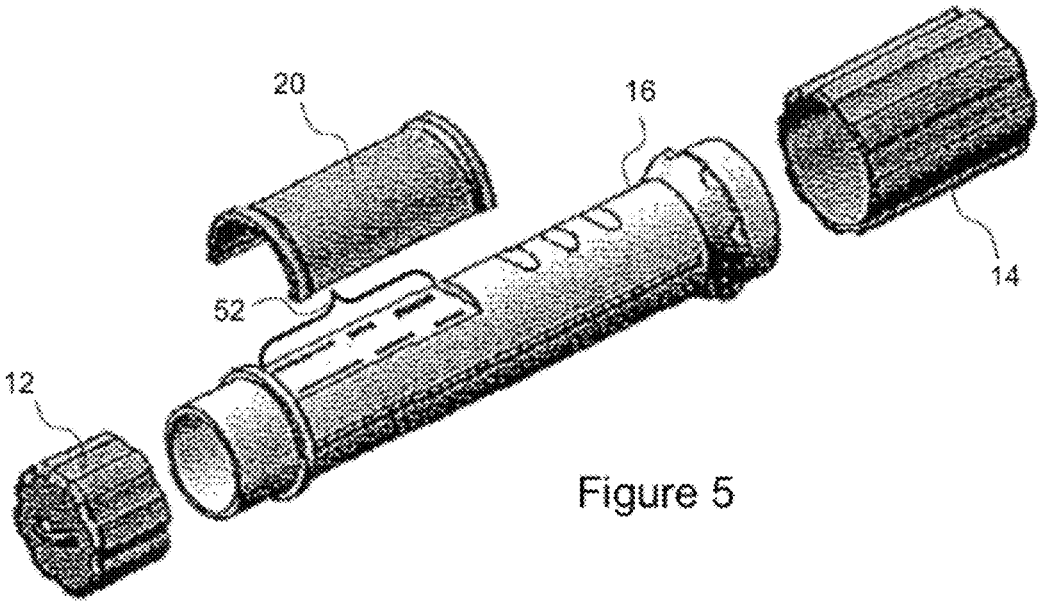
FIG. 5 illustrates an exploded view of the exemplary embodiment in FIG. 1.

FIG. 5 illustrates an exploded view of apparatus 10. FIG. 5 shows the caps 12 and 14 and the cover 20 removed from the shaft 16. The shaft 16 includes a plurality of slots 52 beneath the cover 20 for connecting one or more types of multimedia cards. The multiple slots 52 can be different sizes adapted to accept different types of multimedia cards. For example, with the cover 20 in an open position along the shaft 16, a user may insert a multimedia media card into the appropriate slot 52 to read data from the card. In another example, the cover 20 may be removably attached to the shaft 16, such that when the cover 20 is removed a user can access the slots 52. One or more of the slots can enable a multimedia card reader to read from a USB thumb drive. In an embodiment, the multimedia media card reader(s) may be write-protected. In other words, the readers may be configured to read the cards and thumb drives but not alter the cards and drives. This embodiment may be beneficial in forensic uses.

In addition to the multimedia media card reader slots, the cover 20 may enclose other types of data gathering components. For example, cover 20 may enclose biometric data gathering tools such as a fingerprint scanner.

Figure 6:
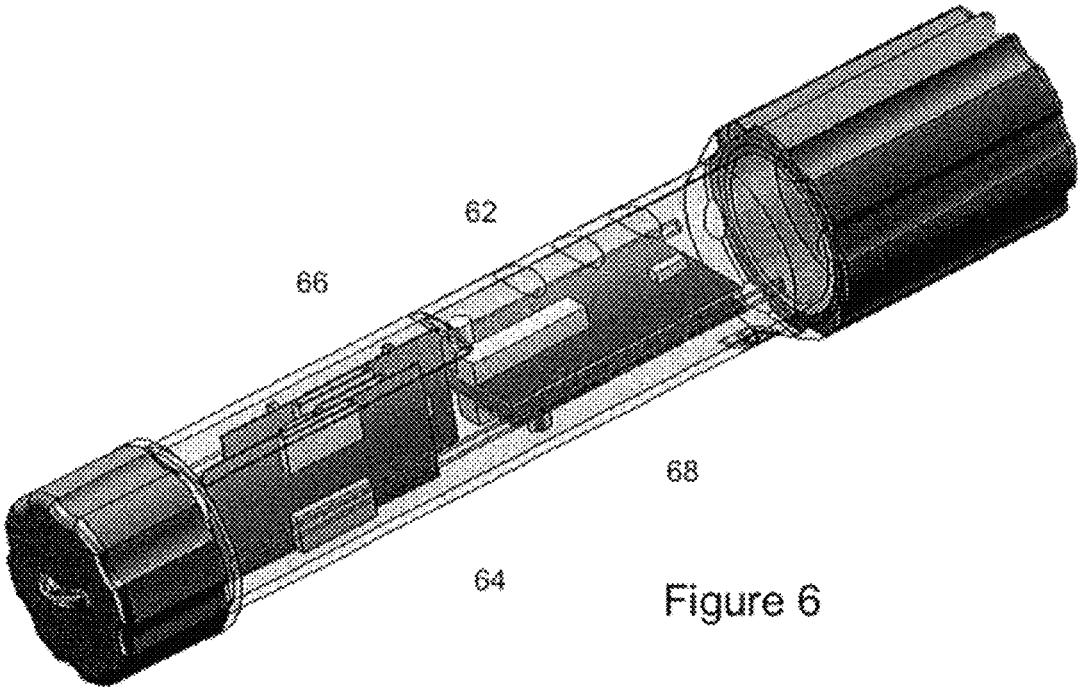
FIG. 6 illustrates an interior view of the exemplary embodiment in FIG. 1.

FIG. 6 illustrates an exemplary interior view of the apparatus 10. As mentioned above, the apparatus 10 is configured to enable a user to connect a computer to different types of multimedia cards and mobile devices. To connect with the multimedia cards and the mobile devices, the apparatus 10 can include USB hubs 62 and 68, and multimedia card readers 64 and 66. Although FIG. 6 shows multiple USB hubs and multimedia card readers, in different embodiments a single USB hub and a single multimedia card reader may be used. However, use of multiple hubs 62 and 68 and readers 64 and 66 may enable use of COTS (commercial-of-the-shelf) products. For example, a COTS multimedia card reader may have two sides where each side can read different types of multimedia cards. Therefore, to position slots 52 together on the same side of the shaft 16, two COTS multimedia card readers oriented in opposite directions may be used.

Figure 7:
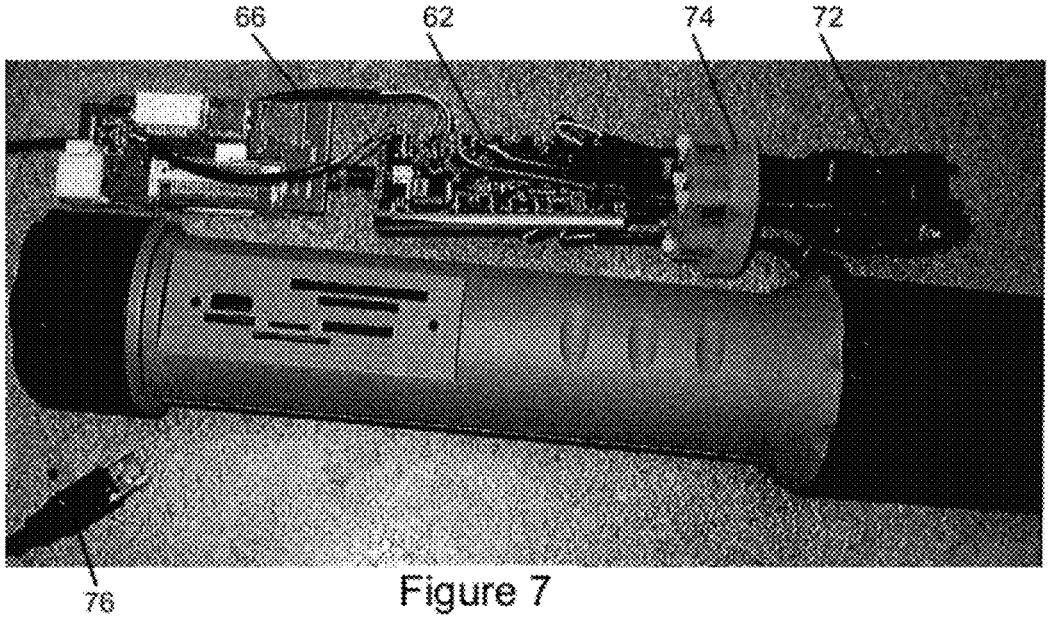
FIGS. 7-9 are photographs of the interior circuitry of the exemplary embodiment in FIG. 3.
Figure 8:
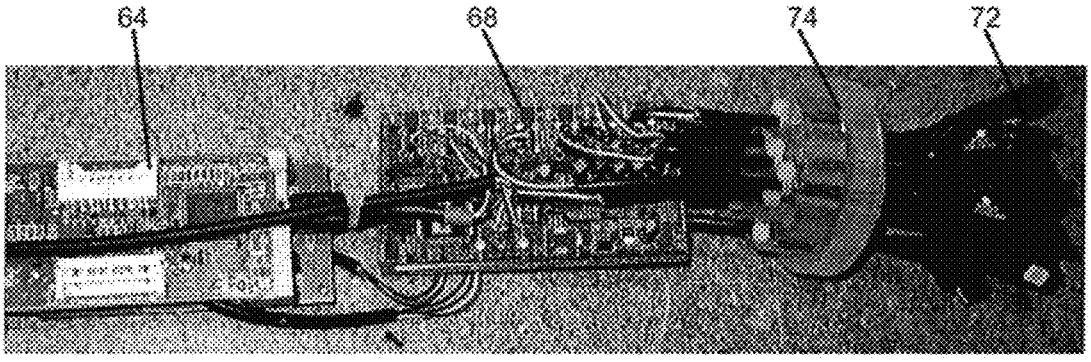
Figure 9:
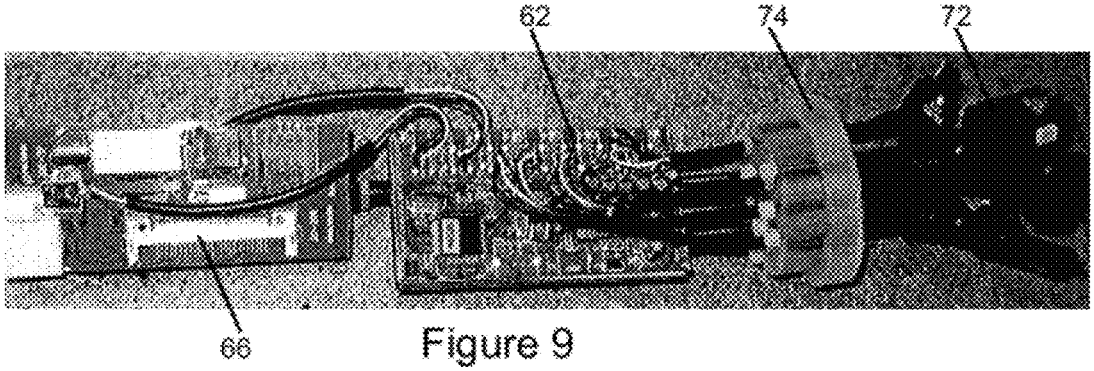

FIGS. 7-9 show photographs illustrating the interior circuitry of the apparatus 10 in one embodiment. FIG. 7 shows a photograph of the interior circuitry along side the exterior enclosure. FIG. 8 shows a photograph of a top view of the interior circuitry of apparatus 10, and FIG. 9 shows a photograph of a bottom view of the interior circuitry of apparatus 10.

FIG. 7 shows multiple cables 72. Each cable 72 is configured to connect to a different type of mobile device. Each cable 72 is threaded through holes in a wiring harness 74. When inserted into the shaft 16, the wiring harness 74 forms a seal that protects the circuitry inside the shaft 16, such as multimedia card readers 64 and 66 and USB hubs 62 and 68. The wiring harness 74 may be at least partially made of silicone. Each cable 72 is coupled to at least one USB hub, such as USB hubs 62 or 68.

FIG. 7 also shows a cable 76 that enables a user to connect apparatus 10 to a computer. The cable 76 may, for example, be a heavy coiled USB cable. The USB hubs may form a network to direct signals from the mobile devices and multimedia card readers to the cable 76. For example, USB hubs 62 and 68 may be coupled to each other, and at least one of the USB hubs 62 and 68 may be coupled to the cable 76. In this way, the USB hubs form a network inside the shaft 16 that connects the multiple mobile device cables 72, the multimedia card readers 64 and 66 and the USB cable 76. In other embodiments, different components may communicate wirelessly through Bluetooth or other wireless specifications.

In an embodiment, a user can connect the cable 76 to a computer that automatically identifies the protocol necessary to extract data from the mobile device and uses the protocol to extract the data. An example computing device that automatically extracts data from a mobile device is described below and in U.S. patent application Ser. No. 61/255,736, entitled "Fast Mobile Device Interrogation System and Applications Thereof," incorporated herein by reference in its entirety.

The apparatus 10 may also charge the connected mobile device. Among other things, the apparatus 10 provides a compact, easy-to-use housing for enclosing and making available cables and slots for multimedia cards to extract data from mobile devices.

Figure 10:
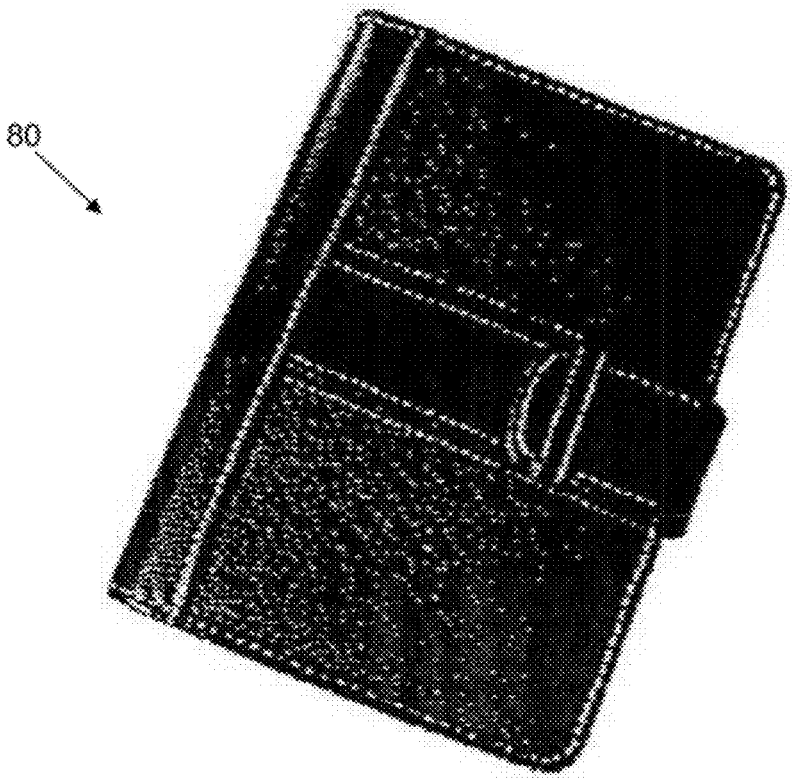
FIG. 10 illustrates an exemplary embodiment of a leather notebook enclosure for mobile device data cables and multimedia card readers.

FIG. 10 illustrates an exemplary embodiment of a leather notebook enclosure 80 for mobile device cables and multimedia card readers. In the embodiment of FIG. 10, the multimedia memory card reader, USB hub, and mobile device data cables are enclosed inside the notebook enclosure 80. The multimedia memory card reader can be mounted on the inside spine of the notebook 80, and the integrated mobile device cables can extend out from the inside spine in an orderly fashion. When the notebook 80 is open, the integrated mobile device cables can be accessed. A connecting heavy coiled USB cable can extend from the left hand inside cover to be connected to a computer USB port. This embodiment may be useful for a law enforcement squad car to enable the officer to quickly connect a device through the notebook 80 to his squad car computer.

Figure 11:
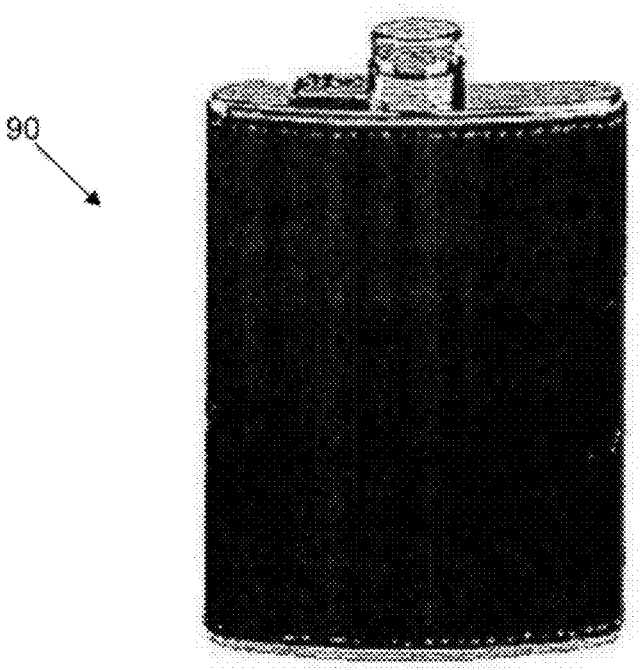
FIG. 11 illustrates an exemplary embodiment of a leather flask enclosure for mobile device data cables and multimedia card readers.

FIG. 11 illustrates an exemplary embodiment of a leather flask enclosure 90 for mobile device data cables and multimedia card readers. In the embodiment of FIG. 11, the multimedia memory card reader, USB hub, and mobile device data cables are enclosed inside the flask enclosure 90. Similar to the notebook embodiment of FIG. 10, the multimedia memory card reader can be mounted on the inside spine of the flask 90, and the integrated mobile device cables can extend out from the inside spine in an orderly fashion. Once the flask 90 is open, the integrated mobile device cables can be accessed. A connecting heavy coiled USB cable can extend from the left hand inside cover of the flask 90 to be connected to a computer USB port. This embodiment may be useful for undercover investigations where covert actions are important.

When interrogating mobile devices, it is important not only to be able to physically connect to the mobile device but also to determine a protocol to communicate with the mobile device and quickly download and/or display data from the mobile device. A data extraction device can receive a product identifier (ID) or a vendor ID from a mobile device when it is connected. The data extraction device can then automatically determine a protocol to communicate with the mobile device based on the product or vendor IDs. The data extraction device can have separate threads for extracting data from a mobile device and displaying the extracted data to a user. In this way, one thread can display the data extracted from the mobile device while the other thread is continuing to extract data.

Figure 12:
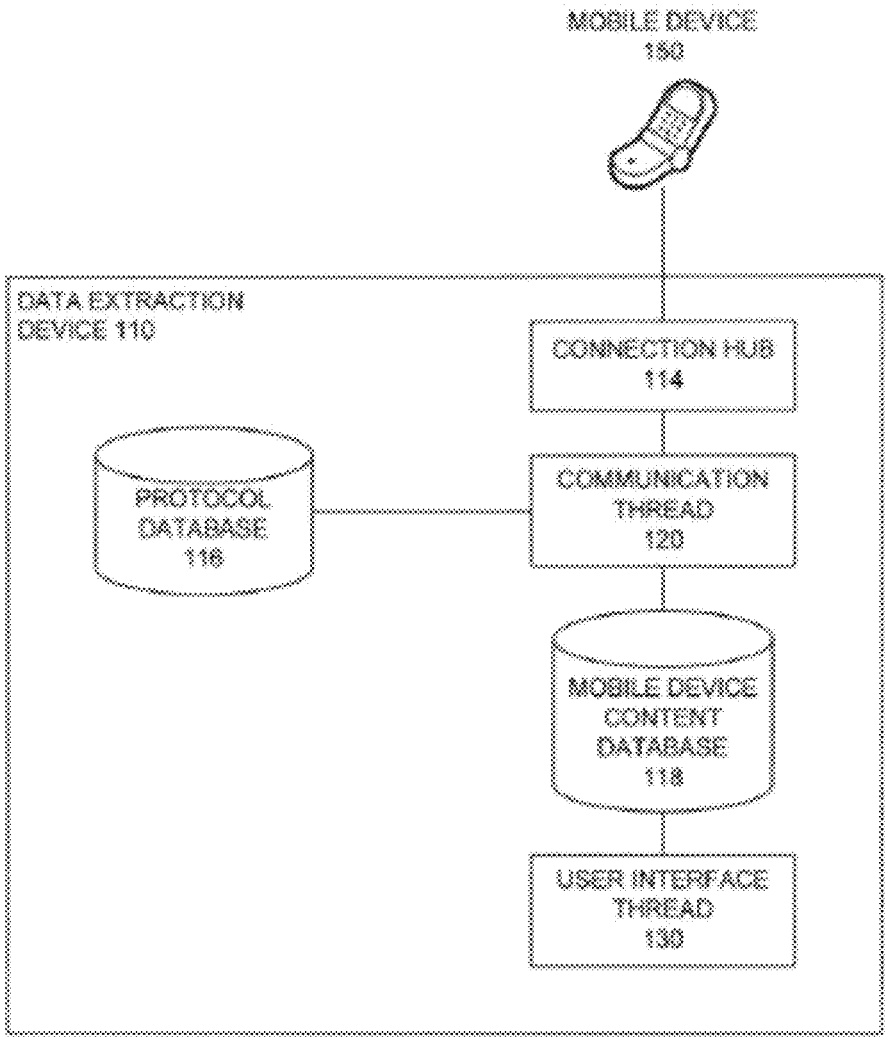
FIG. 12 is a diagram of an exemplary system for interrogating a mobile device.

FIG. 12 is a diagram of an exemplary system 100 for interrogating a mobile device. The system 100 includes a data extraction device 110 coupled to a mobile device 150. The data extraction device 110 includes a connection hub 114, a protocol database 116, a communication thread 120, a mobile device content database 118, and a user interface thread 130.

The system 100 can be configured to operate as follows. A user connects mobile device 150 to a connector in the connection hub 114. Such as one of the mobile device cables or multimedia card connectors in the apparatus 10 described above. Once the mobile device 150 is connected, it transmits protocol identification information including a product ID or a vendor ID to the communication thread 120. The communication thread 120 uses the product ID or vendor ID to identify a protocol in the protocol database 116 to communicate with the mobile device 150. Using the identified protocol, the communication thread 120 extracts data from the mobile device 150 and stores the data into the mobile device content database 118. As the communication thread 120 is extracting data, the user interface thread 130 can be reading data from the mobile device content database 118 and displaying the data to the user. More detail on each of the components and their operation is provided below.

The connector hub 114 can include a plurality of connectors where each connector is configured to connect with a type of mobile device. For example, each connector may include a cable with one terminal end able to connect with a type of mobile device and another end able to connect to a USB hub included in the connector hub 114. Some connectors may include a card reader to read, for example, a flash memory stick or SD card from the mobile device. To prevent loss of the connectors, each connector may be fixed or locked to the USB hub. The connector hub 114 may also include an indicator light (such as an LED light) for each connector. The connector hub 114 may communicate with the communication thread 120 to determine which indicator lights to display. The exemplary apparatus 10 for enclosing mobile device data cables and multimedia card readers described above is an example of the connector hub 114.

The communication thread 120 communicates with the mobile device 150 and extracts data from the mobile device 150. The communication thread 120 may present the user with a list of different manufacturers of mobile devices and the user may select a manufacturer of the mobile device 150. In response to the selection, the communication thread 120 may determine which connectors correspond to that manufacturer and send a signal to the connector hub 114 to illuminate the indicator lights associated with those connectors. The user can then connect the mobile device 150 to the appropriate connector. Once connected, the mobile device 150 transmits protocol identification information, such as a product ID and a vendor ID. The communication thread 120 may use the protocol identification information to look up the information in the protocol database 116. Using the identified protocol, the communication thread 120 can extract data from the mobile device 150 and store the data into the mobile device content database 118.

By using the product and vendor IDs to identify the protocol automatically, embodiments relieve users of having to identify the specific model of the mobile device 150. This feature improves accuracy and usability of the device.

The mobile device content database 118 stores data extracted from the mobile device 150. The mobile device content database 118 may store, for example, device metadata (such as phone number and SIM card information), call history, contacts, SMS messages, and large files such as image files, audio files, video files, and executable files, such as mobile apps.

The user interface thread 130 displays data extracted from the mobile device stored in the mobile device content database 118. The user interface thread 130 can initiate display of content data extracted from the mobile device 150 to a user before the communication thread 120 finishes extracting content data from the mobile device 150. By displaying data as it is extracted, the user is able to view content data from the mobile device 150 while the communication thread 120 is continuing to extract the content data. This features enables first responders, such as law enforcement personnel, to get and respond to data from the mobile device 150 more quickly.

Figure 13:
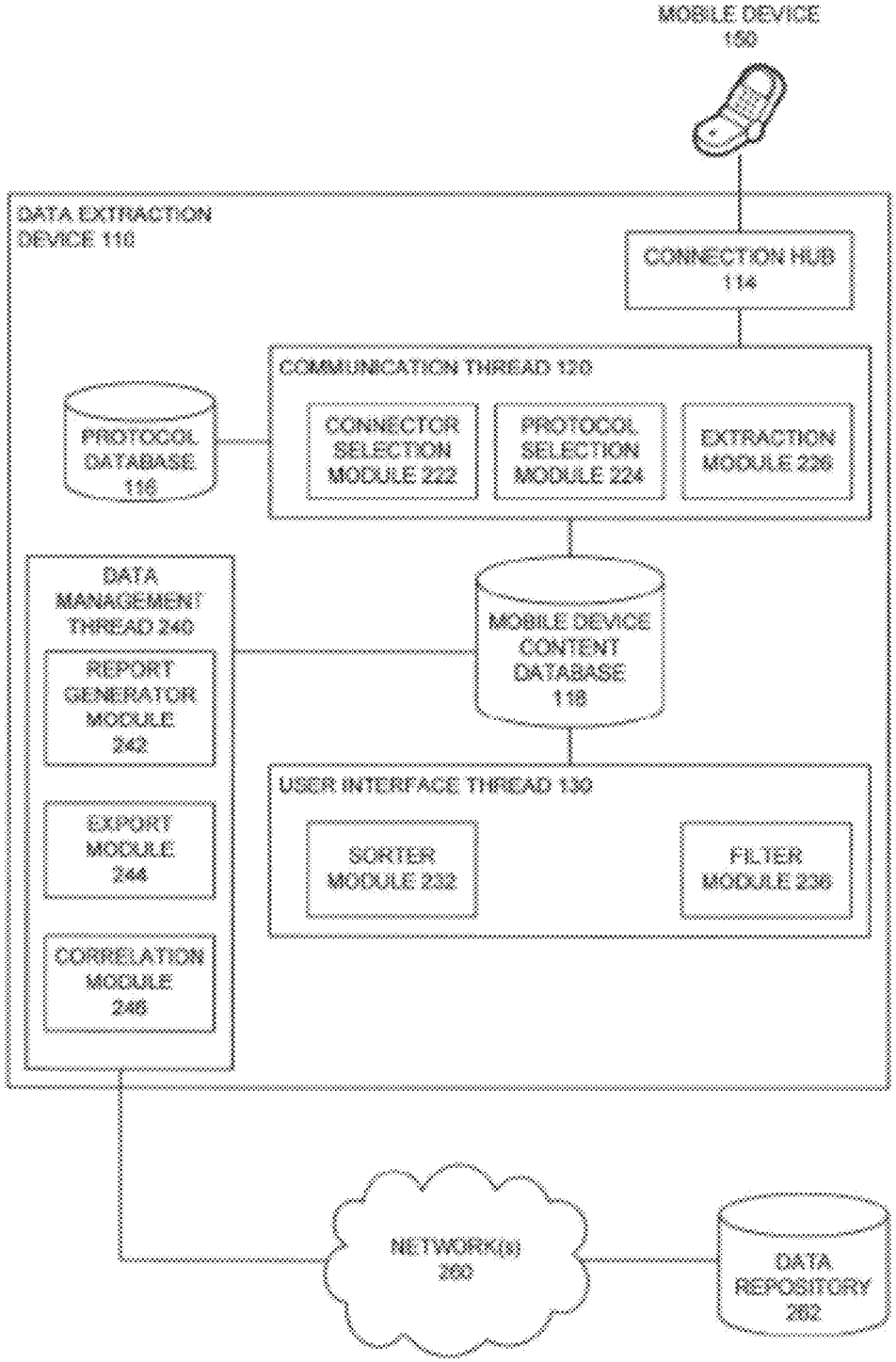
FIG. 13 is a diagram showing the system of FIG. 1 for interrogating a mobile device in greater detail.

An exemplary embodiment of the system 100 and each of its components is described in greater detail with reference to FIG. 13. In FIG. 13, the communication thread 120 executes a connector selection module 222, a protocol selection module 224, and an extraction module 226.

The connector selection module 222 is configured to present mobile device category options to a user. For example, each manufacturer (e.g., Samsung, LG, Motorola, Apple, etc.) may constitute a category of mobile device, and the connector selection module 222 can display a list of different options, with each option corresponding to a mobile device manufacturer. After inspecting the mobile device 150, the user may select the option for the manufacturer of the mobile device 150. The connector selection module 222 can determine which connectors in the connection hub 114 may be used to connect to mobile devices produced by the selected manufacturer. To determine which connectors correspond to the selected manufacturer, the connector selection module 222 can use the protocol database 116. The protocol database 116 can map the manufacturers to the corresponding connectors. After determining which connectors correspond to the selected manufacturer, the connector selection module 222 can send a signal to illuminate indicator lights associated with the potential connectors. By identifying potential connectors, the connector selection module 222 narrows the user's choices of connectors which may connect to mobile device 150. This feature makes the system 100 more user friendly.

Once the indicator lights are illuminated, a user can connect the mobile device 150 to one of the connectors associated with the illuminated lights. When the mobile device 150 is connected, the mobile device 150 sends protocol identification information to the data extraction device 110. For example, the mobile device 150 may communicate with the data extraction device 110 using a USB protocol. In the USB protocol standard handshake, the mobile device 150 can send a device descriptor to the data extraction device 110. The device descriptor may include protocol identification information such as a product ID or a vendor ID. The vendor ID may be assigned to the manufacturer by a central certification authority, such as a USB-IF authority. The product ID may be assigned to that type of mobile device by the manufacturer.

The protocol selection module 224 is configured to receive the protocol identification information including a product ID and a vendor ID. Using the product ID and the vendor ID, the protocol selection module 224 determines the protocol to use to extract data through the connection hub 114. For example, the protocol selection module 224 may query the protocol database 116 to determine the protocol. The protocol may be formatted as a script, or alternatively may be an object, such as a class, implementing a specified interface. More detail on exemplary operation of the connector selection module 222 and the protocol selection module 224 is provided below with reference to FIG. 14. By using the product and vendor IDs to identify the protocol automatically, embodiments relieve users of having to identify the specific model of the mobile device 150.

The extraction module 226 is configured to use the protocol identified by the protocol selection module 224 to extract data from the mobile device 150. Once extracted, the extraction module 226 may store the data in the mobile device content database 118. For example, the data extracted may include device metadata (such as phone number and SIM card information), call history, contacts, SMS messages, and large files (for example, image files, audio files, video files, and mobile apps). In some embodiments, the extraction module 226 can download a list of identifiers for the large files on the mobile device 150. Then, the extraction module 226 can enable a user to selectively download the large files. In this way, the data extraction device 110 does not need to download all of the data on the mobile device 150. An exemplary operation of the extraction module 226 is provided below with reference to FIG. 15.

As mentioned above, the user interface thread 130 displays data extracted from the mobile device 150 and stored in the mobile device content database 118. The user interface thread 130 can include a sorter module 232 and a filter module 236. The sorter module 232 enables a user to alter how the data displayed to the user is sorted. Similarly, the filter module 236 enables a user to filter the data displayed to the user. The sorter module 232 and the filter module 236 may operate, for example, by altering the query used to retrieve data from the mobile device content database 118. Alternatively, the filter module 236 and the sorter module 232 may maintain a temporary table and rearrange and filter contents in the temporary table.

Having a separate thread (the user interface thread 130) to display data as it is extracted enables the user to view content data of the mobile device 150 while the communication thread 120 is continuing to extract the content data. This enables users to view and act upon data from the mobile device 150 more quickly.

In addition to the communication thread 120 and the user interface thread 130, the data extraction device 110 also includes a data management thread 240. The data management thread 240 performs operations to manage and analyze the data extracted from the mobile device 150. The data management thread 240 includes a report generator module 242, an export module 244, and a correlation module 246.

The report generator module 242 generates reports based on the data extracted from the mobile device 150. For example, the report generator module 242 can arrange the report in a pre-configured format. the report generator module 242 can generate the report as a document, such as an ADOBE PDF or MICROSOFT WORD document. The report may also be formatted in a comma-delimited text or XML format. By generating a report, the data extracted from the mobile device 150 is presented and preserved in a manner easily understandable to a user.

The export module 244 can export data extracted from the mobile device 150. For example, the export module 244 can send the data (perhaps formatted as a report generated by the report generator module 242) to another computing device (not shown) via one or more network(s) 260. For example, the export module 244 may send the data to another computing device via a USB connection or other way known to those of skill in the art. In some embodiments, the export module may timestamp and digitally sign the data to ensure authenticity for evidence purposes.

The correlation module 246 is configured to communicate with a data repository 262 via one or more networks 260 and possibly intermediate servers (not shown). The correlation module 246 is configured to correlate data extracted from the mobile device 150 with data from the data repository 262. For example, the correlation module 246 may determine whether any of the contact or call history information in the mobile device 150 corresponds to any outstanding warrants; or the correlation module 246 may compare contact or call history information in the mobile device 150 with information previously collected from another mobile device.

The mobile device 150 may be any type of mobile device including, but not limited to, cell phones, Personal Digital Assistants (PDAs), smart phones, GPS devices, Subscriber Identity Module (SIM) cards, memory sticks, and MP3 players.

The data extraction device 110 may be implemented on any type of computing device. Such computing device can include, but is not limited to, a personal computer, mobile device, mobile phone, workstation, embedded system, game console, television, set-top box, or any other computing device. Further, a computing device can include, but is not limited to, a device having a processor and memory for executing and storing instructions. Software may include one or more applications and an operating system. Hardware can include, but is not limited to, a processor, memory and graphical user interface display. The computing device may also have multiple processors and multiple shared or separate memory components. For example, the computing device may be a clustered computing environment or server farm.

Each of the data management thread 240, the user interface thread 130, and the communication thread 120 can be a separate thread of execution. As would be understood by a person of skill in the art, each of the threads 240, 130, and 120 may be different threads in a single process or different processes.

Each of the connector selection module 222, the protocol selection module 224, the extraction module 226, the report generator module 242, the export module 244, the correlation module 246, the sorter module 232 and the filter module 236 may be any type of structured memory, including a persistent memory. For example, each database may be implemented as a relational database.

Example operations of the system 100 are described below with reference to FIGS. 14 and 15.

Figure 14:
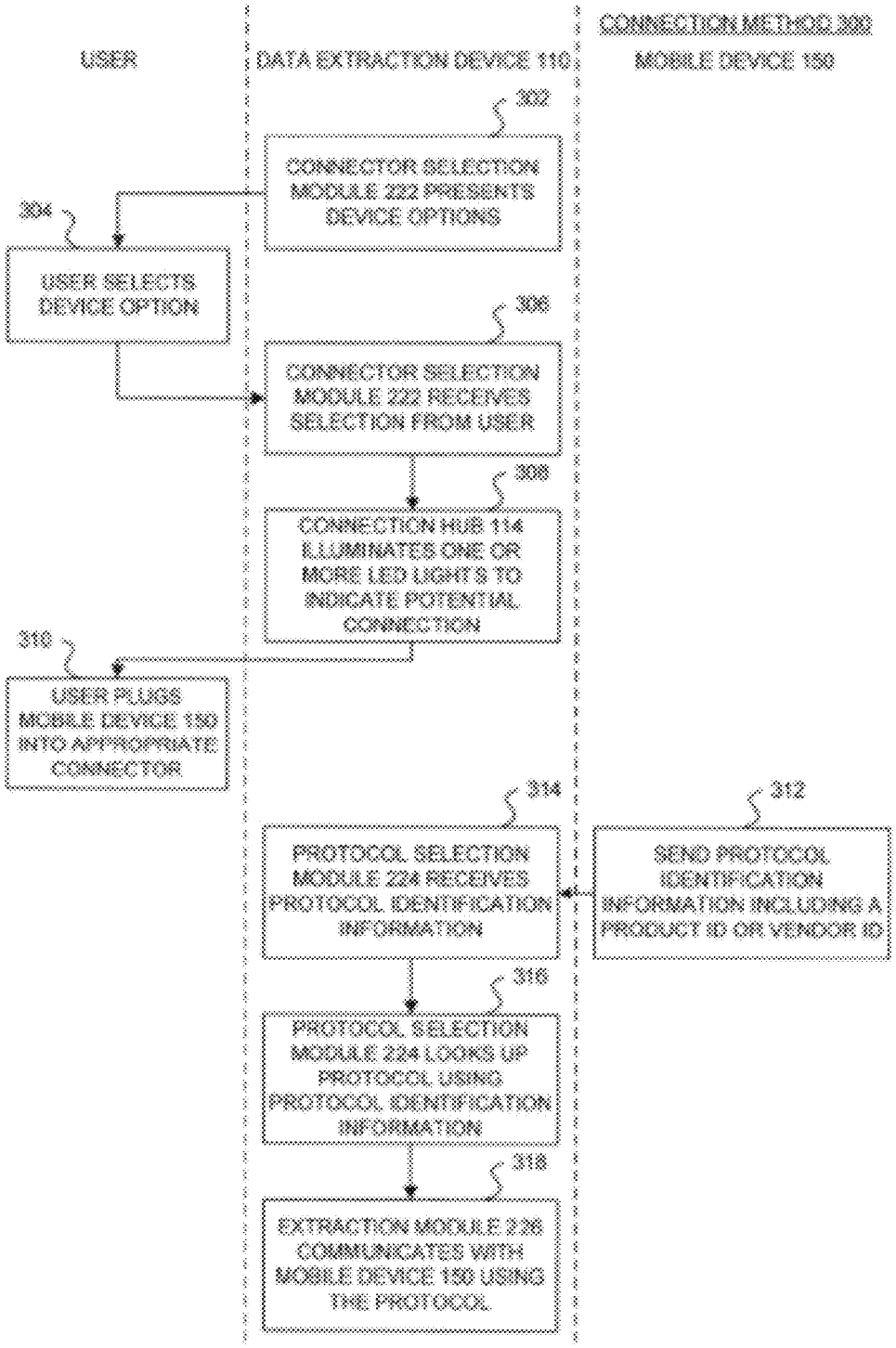
FIG. 14 is a flowchart showing a method for connecting to a mobile device.

FIG. 14 is a flowchart showing an exemplary method 300 for connecting with a mobile device. For clarity, the method 300 is described with respect to components of the system 100 shown in FIGS. 12 and 13. However, the method 300 is not meant to be limited thereto. The method 300 may be used in other contexts as would be recognized by a person of skill in the art.

The method 300 begins with the connector selection module 222 presenting mobile device category options to a user at step 302. For example, the connector selector module 222 may present options corresponding to different manufacturers of mobile devices. At step 304, a user selects a device option. For example, the user may select a button on a touch screen corresponding to the device option. For example, if mobile device 150 is a MOTOROLA product, the user may select the button for the MOTOROLA device category. At step 306, the connector selection module 222 receives the user selection.

Based on the selection, the connector selection module 222 determines which connector(s) correspond to the selected manufacturer and sends a signal to illuminate indicator lights associated with those connectors at step 308. At step 310, the user determines which of the illuminated connectors fits the mobile device 150, and connects the mobile device 150 to that connector.

Once the user connects the mobile device 150, the mobile device 150 sends protocol identification information including a product ID or a vendor ID to the data extraction device 110 at step 312. At step 314, the protocol selection module 224 receives the protocol identification information. For example, the mobile device 150 may communicate with the data extraction device 110 using a USB protocol. In the USB protocol standard handshake, the mobile device 150 may send a device descriptor to the data extraction device 110. The device descriptor may include protocol identification information such as a product ID or a vendor ID.

At step 316, the protocol selection module 224 identifies a protocol using the protocol identification information received at step 314. In some embodiments, each vendor ID can have a corresponding protocol. That protocol is selected, unless the product ID indicates that the mobile device 150 runs on a particular operating system, such as a MICROSOFT POCKET PC operating system. For example, the vendor ID may indicate that the mobile device 150 was manufactured by MOTOROLA. In that example, the protocol selection module 224 identifies the protocol used for MOTOROLA phones, unless the product ID indicates that it was a MOTOROLA model that used a MICROSOFT POCKET PC operating system. If the product ID indicates that it was a MOTOROLA model that used a MICROSOFT POCKET PC operating system, then the protocol selection module 224 identifies the protocol used to communicate with devices running the MICROSOFT POCKET PC operating system. By using the product and vendor IDs to identify the protocol automatically, the system 100 can relieve users of having to identify the specific model of mobile device 150. Once a protocol is determined, the extraction module 226 uses the protocol to extract data from the mobile device 150 at step 318. An exemplary method for extracting data is described below with reference to FIG. 15.

Figure 15:
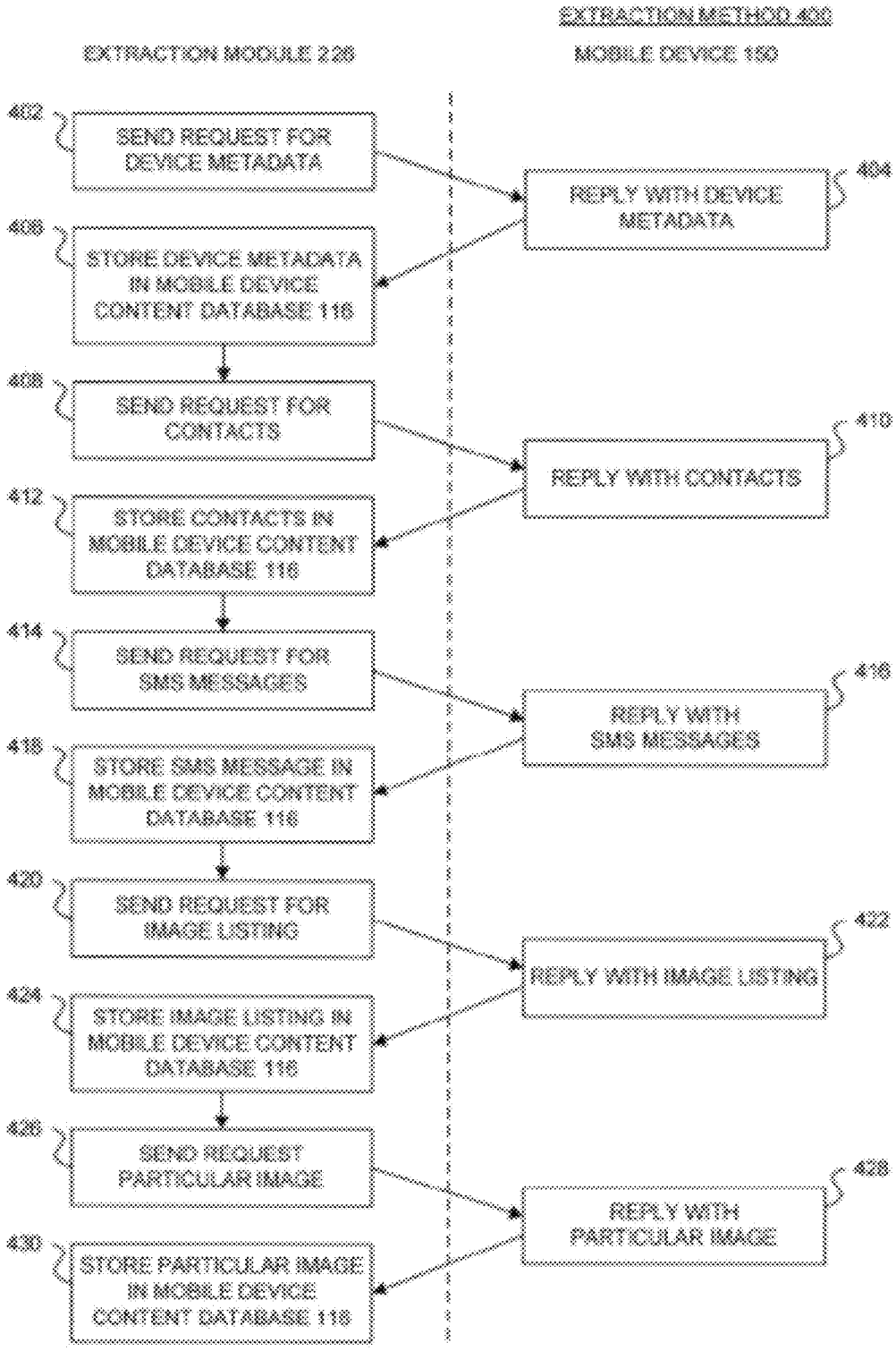
FIG. 15 is a flowchart showing a method for extracting data from a mobile device.

FIG. 15 is a flowchart showing an exemplary method 400 for extracting data from a mobile device. In general, data likely to be significant should be extracted before data not likely to be significant. Further, data that may be downloaded quickly should be extracted before data that takes a longer time to download. Other methods may be used as would be known to those of skill in the art. Further, depending on the protocol used the number and sequence of requests used may vary from the method 400. For clarity, the method 400 is described with respect to components of the system 100 shown in FIGS. 12 and 13. However, the method 400 is not meant to be limited thereto. The method 400 may be used in other contexts as would be recognized by a person of skill in the art.

The method 400 begins by sending a request for device metadata at step 402. Device metadata may include information about the mobile device 150, including the make and model number of the mobile device 150, the software version that the device 150 is running, the phone number of the device 150, the nearest cell tower, etc. At step 404, the mobile device 150 replies with the device metadata. At step 406, the extraction module 226 receives the device metadata and stores the device metadata in the mobile device content database 118.

At step 408, the extraction module 226 sends a request for the contacts stored in the mobile device 150. For example, a contact may include a name, title, place of business, telephone numbers (mobile, work, home, fax, etc), email address and snail mail address. At step 410, the mobile device 150 replies with the contacts. At step 412, the extraction module 226 receives the contacts and stores the contacts in the mobile device content database 118.

At step 414, the extraction module 226 sends a request for the short message service (SMS) messages stored in the mobile device 150. An SMS message may be a short text message (e.g., 140 characters or less). For example, the extraction module 226 may request both the text of the message itself and metadata such as the phone number of the sender and the time it was received. In other examples, the extraction module 226 may request image and video messages as well. At step 416, the mobile device 150 replies with the SMS messages. At step 418, the extraction module 226 receives the messages and stores them in the mobile device content database 118.

At step 420, the extraction module 226 sends a request for a listing of images stored in the mobile device 150. For example, the image listing may include a plurality of identifiers where each identifier corresponds to an image in the mobile device 150. The identifier may be a file name. The image listing may also include a timestamp of each image (such as the time it was created) and a thumbnail image. At step 422, the mobile device 150 replies with the image listing. At step 424, the extraction module 226 receives the image listing and stores the image listing in the mobile device content database 118.

In response to a user selection, the extraction module 226 sends a request for a particular image to the mobile device 150 at step 426. The requested image may correspond to the user selection. The mobile device 150 replies with the particular image at step 428. At step 430, the image is stored in the mobile device content database 118. By first requesting a listing of images and then requesting a specific image, the extraction module 226 can selectively download images and avoid the need to download each and every image in the mobile device 150. While the method 400 shows downloading images as an example, persons of skill in the art would recognize that steps 420-430 may be used to selectively download other large files (e.g., video, audio, and executable files) as well.

Figure 16:
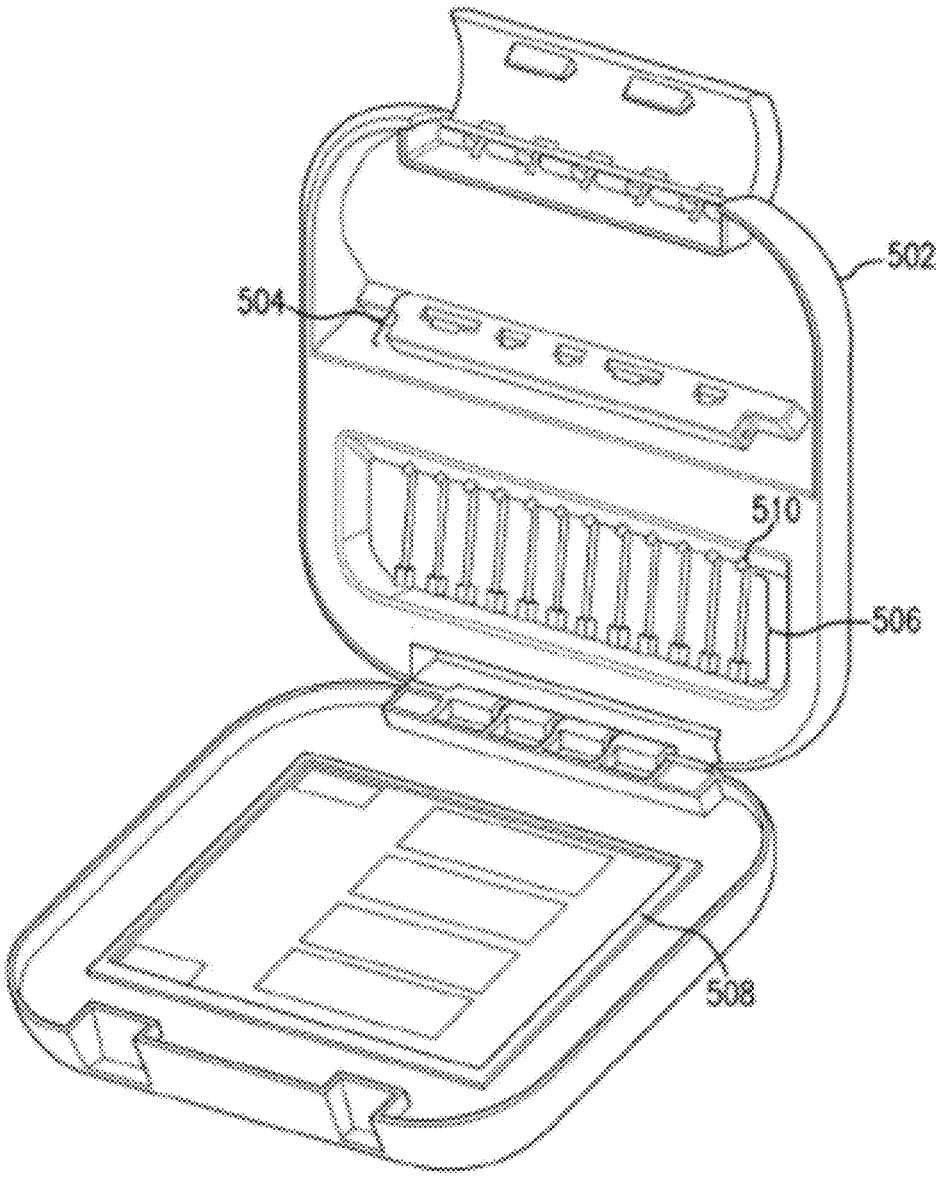
FIG. 16 is a diagram of a forensic kit.

FIG. 16 is a diagram of an exemplary forensic kit 500. The forensic kit 500 can quickly extract data from mobile devices. For protection from damage, dust, and debris, the forensic kit 500 has a hard outer shell 502. Enclosed in the outer shell 502, is a computing device with a touch screen 508. The forensic kit 500 can also includes a plurality of connectors 506. Each connector can have a corresponding indicator light, such as indicator light 510. The forensic kit 500 can also include a plurality of card readers 504.

The forensic kit 500 can automatically determine a protocol to communicate with a mobile device and quickly download and display data from the mobile device onto the touch screen 508. In this way, the forensic kit 500 can assist private investigators, law enforcement, and other government agencies in the conduct of investigations.

Figure 17:
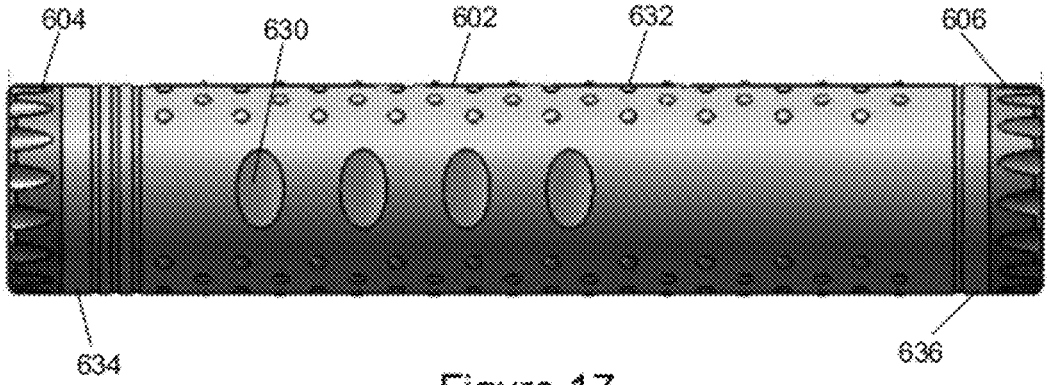
FIG. 17 shows an exterior view of an alternative embodiment of an apparatus for enclosing device data cables and multimedia card readers.

FIGS. 17-24 show an alternative embodiment 600 of an apparatus for enclosing a plurality of device cables and multimedia card readers. FIG. 17 shows an exterior view of the apparatus 600 which includes a generally tubular shaft 602 with indentations 630 and bumps 632 for easy gripping. The shaft 602 extends from a first end 634 to a second end 636. The apparatus 600 also includes a first end cap 604 enclosing the first end 634 of the shaft 602 and a second end cap 606 enclosing the second end 636 of the shaft 602.

Figure 18:
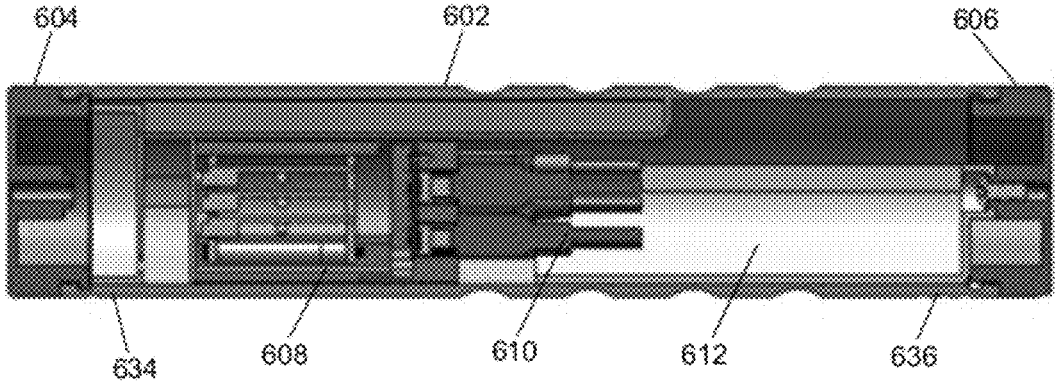
FIG. 18 shows a cross-section interior view of the alternative embodiment of FIG. 17.

FIG. 18 shows a cross-section of the apparatus 600 cut down the center of the shaft 602. The cross-section shows the interior of the apparatus 600 which includes a USB housing 608, a slide 612, and a plurality of connector cables 610 which can include multimedia card readers on the ends of connector cables 610. For clarity, the cables are not shown in this figure. The slide 612 is coupled to the second end cap 606 and to the USB housing 608. By pulling the second end cap 606 away from the shaft 602, the slide 612 and the USB housing 608 slide along the interior of the shaft 606 to expose the plurality of connector cables 610.

Figure 19:
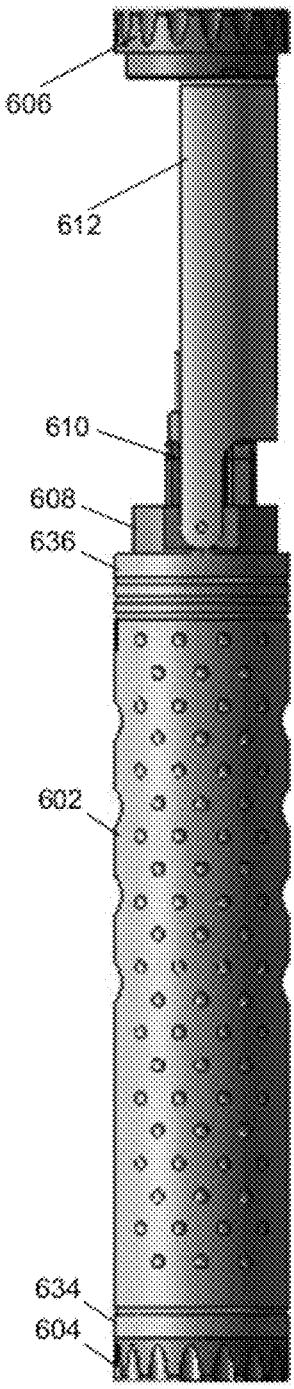
FIG. 19 shows a side view of the alternative embodiment of FIG. 17 with the slide extended.
Figure 20:
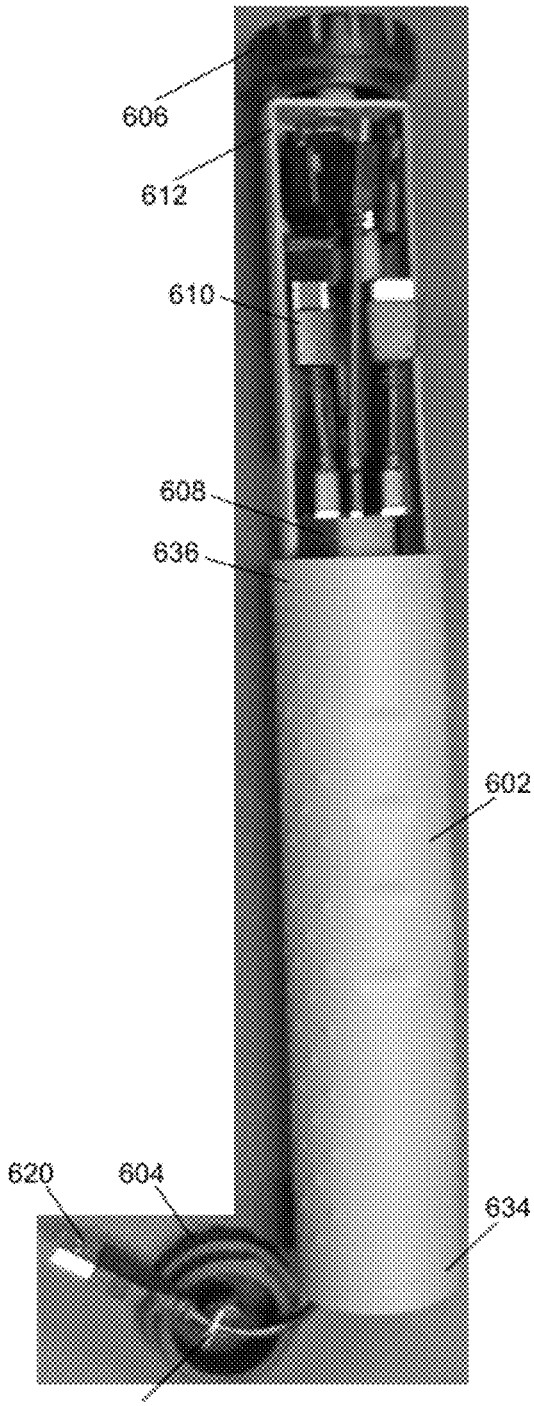
FIG. 20 shows a top view of an implementation of the alternative embodiment of FIG. 17 with both end caps detached from the shaft and the slide extended.

FIG. 19 shows a side-view of the second end cap 606 and the slide 612 extended from the shaft 602 which pulls the USB housing 608 to the second end 636 of the shaft 602. FIG. 20 shows a top view of an actual implementation of this embodiment. FIG. 20 also shows the first end cap 604 detached from the shaft 602 which exposes a USB connector 620 that extends from the first end 634 of the shaft 602. The USB connector 620 is connected to one side of the USB housing facing the first end cap 604, and the plurality of connector cables 610 are connected to the opposite side of the USB housing 608 facing the second end cap 606. The USB connector 620 can be connected to a computer to enable data from mobile devices and/or multimedia cards connected to the plurality of connector cables 610 to be extracted through the USB housing 608. FIG. 20 also shows a connector 622 connecting the first end-cap 602 to the USB cable 620. Thus both end caps 604, 606 are connected to the rest of the apparatus 600, the first end cap 604 is connected to the USB cable 620 and the second end cap 606 is connected to the end of the slide 612.

Figure 21:
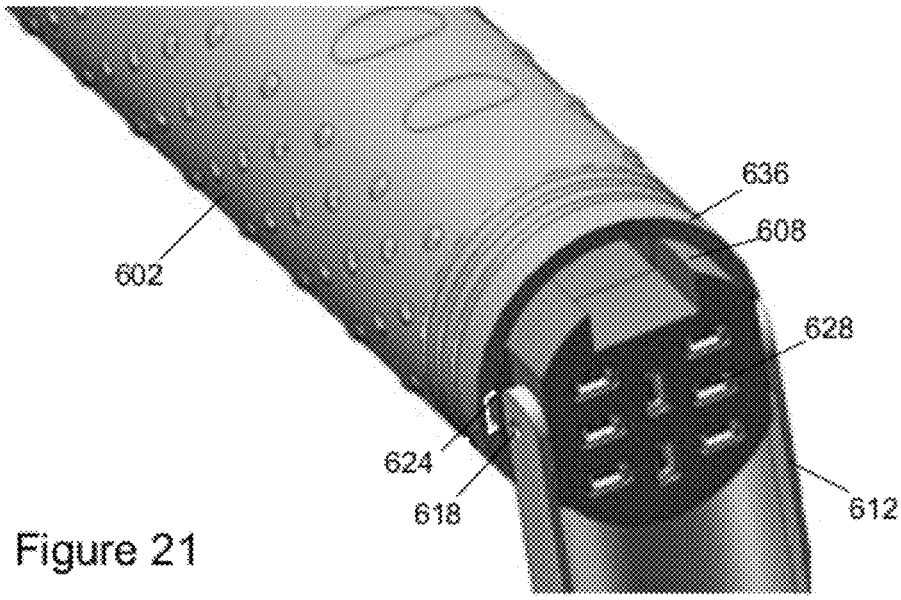
FIG. 21 shows a close-up view of the second end of the shaft with the slide fully extended.
Figure 22:
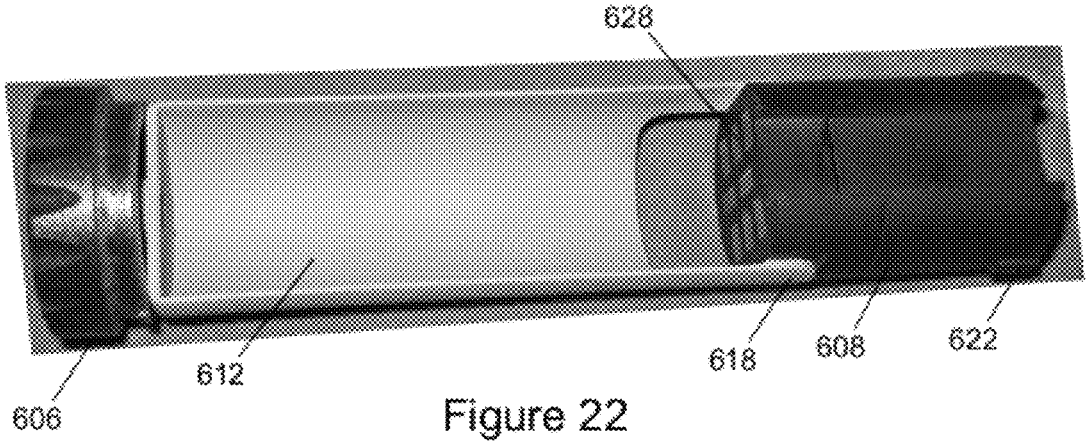
FIG. 22 shows an implementation of the USB housing, the slide and the second end cap removed from the shaft.
Figure 23:
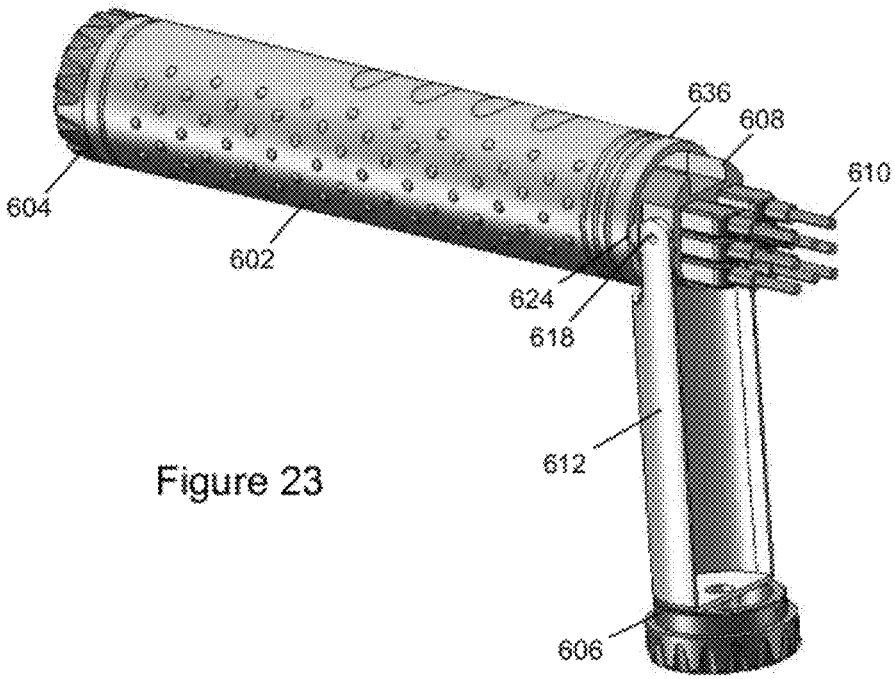
FIG. 23 shows the alternative embodiment of the apparatus of FIG. 17 with the slide fully extended and pivoted perpendicular to the central axis of the shaft exposing the device data cables and multimedia card readers.
Figure 24:
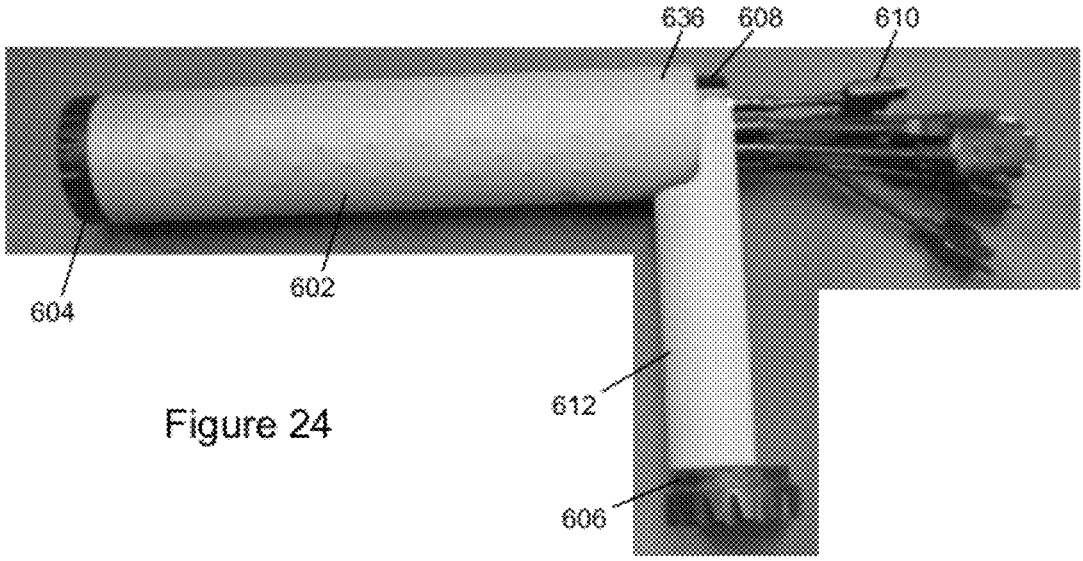
FIG. 24 shows an implementation of the alternative embodiment of the apparatus of FIG. 17 with the slide fully extended and pivoted perpendicular to the central axis of the shaft exposing the device data cables and multimedia card readers.

FIG. 21 shows a close-up view of the second end 636 of the shaft 602 with the slide 612 fully extended. FIG. 22 shows an actual implementation of the USB housing 608, the slide 612 and the second end cap 606 without the shaft 602. These figures show that this embodiment of the USB housing 608 includes eight mini-USB connectors 628. Each of these mini-USB connectors 628 can be used to connect one of the cables 610 to a computer through the USB housing 608 and the USB cable 620. The slide 612 is connected to the USB housing 608 at pivot points 618 on opposite sides of the USB housing 608 such that the slide 612 pivots or swings down out of the way exposing the cables 610. This is shown in FIGS. 23 and 24. When the slide 612 is swung down it helps lock the USB housing 608 at the second end 636 of the shaft 602 to keep the cables 610 easily accessible.

FIG. 21 shows the end of a channel 624 that extends along the interior of the shaft 602, and FIG. 22 shows a tab 622 that extends out from the USB housing 608. The tab 622 travels down the channel 624 along with the USB housing 608 as the slide 612 is pulled in and out of the shaft 602. The end of the channel 624 at the second end 636 of the shaft 602 can be narrowed or closed off to prevent the tab from coming out of the second end 636 of the shaft 602 which prevents the USB housing 608 from being pulled out of the shaft 602.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

We claim:

1. An apparatus for connecting a computing device to different types of mobile devices, comprising:

an enclosure;

a USB hub within the enclosure;

a plurality of mobile device cables, each mobile device cable having a first end coupled to the USB hub and a second end having an external device connector; each external device connector for connecting to a mobile device external to the enclosure;

a slide having a proximal end and a distal end, the slide being coupled to the enclosure, wherein the slide slides from a closed position wherein the proximal and distal ends of the slide and the plurality of mobile device cables are enclosed in the enclosure to an extended position wherein the distal end of the slide and the plurality of mobile device cables extend outside the enclosure; and a USB cable having a first end coupled to the USB hub and a second end for connecting to the computing device;

wherein the computing device extracts data from a mobile device coupled to the external device connector of one of the plurality of mobile device cables.

2. The apparatus of claim 1, wherein each of the external device connectors of the plurality of mobile device cables are connectable to at least one of a cell phone, a smart phone, and a personal digital assistant.

3. The apparatus of claim 1, wherein at least one of the external device connectors of the plurality of mobile device cables is a multimedia card reader having a slot for accepting a multimedia card.

4. The apparatus of claim 3, wherein at least one of the external device connectors that is a multimedia card reader is write-protected to only read information from a connected multimedia card.

5. The apparatus of claim 1, further comprising a biometric data gathering tool enclosed within the enclosure.

6. The apparatus of claim 5, wherein the biometric data gathering tool is a fingerprint scanner.

7. The apparatus of claim 1, further comprising a cover coupled to the enclosure, the cover moving between an open position exposing the plurality of external device connectors and a closed position enclosing the plurality of external device connectors in the enclosure behind the cover.

8. The apparatus of claim 1, wherein the enclosure has a tubular exterior shape extending from a first end to a second end, the first end of the enclosure enclosing the second end of the USB cable and the second end of the enclosure enclosing the external device connectors of the plurality of mobile device cables.

9. The apparatus of claim 8, further comprising a first end cap covering the first end of the enclosure and a second end cap covering the second end of the enclosure.

10. The apparatus of claim 9, further comprising a first cord and a second cord, the first cord coupling the first end cap to the enclosure and the second cord coupling the second end cap to the enclosure.

11. The apparatus of claim 1, further comprising a light movable from an enclosed position within the enclosure to an extended position outside of the enclosure.

12. The apparatus of claim 1, further comprising a wiring harness at least partially within the enclosure, the wiring harness separating the enclosure to form a proximal side and a distal side, the plurality of mobile device cables being on the distal side of the wiring harness; the USB cable being on the proximal side of the wiring harness.

13. The apparatus of claim 12, wherein the wiring harness includes a plurality of mini-USB connectors coupled to the USB hub, the first end of each of the plurality of mobile device cables being coupled to one of the mini-USB connectors of the wiring harness.

14. The apparatus of claim 12, wherein the wiring harness is coupled to the proximal end of the slide.

15. The apparatus of claim 14, further comprising an end cap coupled to the distal end of the slide, wherein when the slide is in the closed position the end cap connects to the enclosure sealing the distal side of the enclosure.

16. The apparatus of claim 15, further comprising a hinge coupling the slide to the wiring harness and wherein the enclosure has a longitudinal axis extending along the length of the enclosure, wherein when the slide is in the closed position the slide is generally parallel to the longitudinal axis of the enclosure, and when the slide is in the extended position the slide pivots on the hinge and the slide is generally perpendicular to the longitudinal axis of the enclosure.

17. The apparatus of claim 16, wherein the wiring harness includes a plurality of mini-USB connectors coupled to the USB hub, the first end of each of the plurality of mobile device cables being coupled to one of the mini-USB connectors of the wiring harness.

18. The apparatus of claim 1, further comprising an end cap coupled to the distal end of the slide, wherein when the slide is in the closed position the end cap connects to the enclosure.

19. The apparatus of claim 1, wherein the enclosure has a tubular exterior shape extending from a first end to a second end, and the apparatus further comprises a first end cap covering the first end of the enclosure and a second end cap covering the second end of the enclosure; the first end of the enclosure enclosing the second end of the USB cable and the second end of the enclosure enclosing the external device connectors of the plurality of mobile device cables; the slide extending out of the second end of the enclosure when in the extended position.

* * * * *